US007922031B1

(12) United States Patent
Prince

(10) Patent No.: US 7,922,031 B1
(45) Date of Patent: Apr. 12, 2011

(54) INSULATOR SLEEVE FOR A BEVERAGE CONTAINER

(76) Inventor: Kevin R. Prince, San Juan Capistrano, CA (US)

( * ) Notice: Subject to any disclaimer, the term of this patent is extended or adjusted under 35 U.S.C. 154(b) by 1076 days.

(21) Appl. No.: 11/680,990

(22) Filed: Mar. 1, 2007

Related U.S. Application Data

(60) Provisional application No. 60/767,076, filed on Mar. 1, 2006.

(51) Int. Cl.
*B65D 3/00* (2006.01)

(52) U.S. Cl. ..... 220/739; 220/737; 220/738; 220/903; 229/403

(58) Field of Classification Search ..... 220/737, 220/738, 739, 903; 229/403
See application file for complete search history.

(56) References Cited

U.S. PATENT DOCUMENTS

| | | | | |
|---|---|---|---|---|
| 4,335,609 | A * | 6/1982 | Saulsbury | 73/426 |
| 5,320,249 | A | 6/1994 | Strech | |
| 5,553,735 | A * | 9/1996 | Kimura | 362/101 |
| 5,667,135 | A | 9/1997 | Schaefer | |
| 5,746,372 | A | 5/1998 | Spence | |
| 6,152,363 | A | 11/2000 | Rule, Jr. | |
| 6,158,612 | A | 12/2000 | Alpert | |
| 6,182,855 | B1 | 2/2001 | Alpert | |
| 6,250,005 | B1 | 6/2001 | Richards | |
| 6,286,709 | B1 | 9/2001 | Hudson | |
| 6,315,192 | B1 | 11/2001 | Marlow | |
| 6,814,253 | B2 | 11/2004 | Wong | |
| 2004/0070222 | A1 | 4/2004 | Wong | |
| 2006/0108373 | A1 * | 5/2006 | Cheng | 220/717 |

* cited by examiner

*Primary Examiner* — Anthony Stashick
*Assistant Examiner* — Elizabeth Volz
(74) *Attorney, Agent, or Firm* — QuickPatents, Inc.; Kevin Prince

(57) ABSTRACT

An insulating sleeve combination for a frusto-conical beverage cup having an outer peripheral surface is disclosed, as well as a method of use thereof. The combination includes an opaque frusto-conical inner sleeve and a frusto-conical outer sleeve. At least a portion of the outer sleeve is transparent or translucent, such that indicia on the inner sleeve is visible or at least partially visible therethrough. The outer surface of the outer sleeve may includes a textured gripping surface, facilitating the manual grasping of the combination by the user. As such, a customized inner sleeve may be marked to indicate a favorite drink of the user, for example, with the markings being visible through the outer sleeve. The combination of the present invention is designed for repeated use, rendering prior art disposable sleeves unnecessary.

13 Claims, 2 Drawing Sheets

INSULATOR SLEEVE FOR A BEVERAGE CONTAINER

CROSS-REFERENCE TO RELATED APPLICATIONS

This application claims the benefit of U.S. Provisional Patent Application 60/767,076, filed on Mar. 1, 2006.

STATEMENT REGARDING FEDERALLY SPONSORED RESEARCH AND DEVELOPMENT

Not Applicable.

FIELD OF THE INVENTION

The present invention relates generally to beverage cups and, more particularly, to a novel coffee cup sleeve.

BACKGROUND AND DESCRIPTION OF THE PRIOR ART

With the increase in popularity of retail coffee establishments such as Starbucks, Seattle's Best Coffee, Dietrich's Coffee, and the like, the use of disposable paperboard coffee cups has increased dramatically. Such cups transmit heat fairly well, and as a result various types of disposable coffee cup sleeves have been devised to eliminate the previous practice of "double cupping," wherein an additional paperboard coffee cup was used to insulate the heat of the coffee from the consumer's hand. Such disposable sleeves use far less paper or paperboard than an additional cup, yet provide even better insulating characteristics. As a result, use of such disposable sleeves has saved a significant amount of paperboard material and has considerably benefited the environment.

Examples of such sleeves can be found in the following references: U.S. Pat. No. 6,152,363 to Rule, Jr. on Nov. 28, 2000; U.S. Pat. No. 5,667,135 to Schaefer on Sep. 16, 1997; U.S. Pat. No. 5,857,615 to Rose on Jan. 12, 1999; and U.S. Pat. No. 6,315,192 to Marlow on Nov. 13, 2001. Of particular interest in the present invention is U.S. Pat. No. 6,182,855 to Alpert on Feb. 6, 2001, which teaches a translucent or transparent sleeve such that an indicia printed on the cup may be seen therethrough. Also, U.S. Pat. No. 6,814,253 to Wong on Nov. 9, 2004 teaches an opaque sleeve having a surface suitable for printing an indicia thereon.

While such sleeve devices have benefited environment by reducing waste, prior art sleeves are still designed to be disposed of after use. Moreover, if a consumer retains such a sleeve with the intention of re-using it, and since such devices are typically made from paperboard or corrugated paper stock, they are prone to becoming stained with coffee or other foodstuffs. Even if a customer's favorite drink has been printed on such a sleeve for the benefit of the barista making the coffee drink, the device is only re-usable a finite number of times before its living hinges wear-out or it becomes unsightly and an embarrassment.

To reduce still further the environmental burden caused by the large number of such disposable sleeves being manufactured, used once, and then discarded, other sleeve devices have been invented that are either designed to be non-disposable or biodegradable. Such devices are described in U.S. Pat. No. 5,320,249 to Strech on Jun. 14, 1994; U.S. Pat. No. 6,286,709 to Hudson on Sep. 11, 2001; and U.S. Pat. No. 5,746,372 to Spence on May 5, 1998.

A significant drawback to the biodegradable devices is that one device must be used and purchased with each beverage purchase. As such, these products are still relatively expensive to supply to each customer and result in greater expense for the retail coffee establishment. Customarily, such establishments are typically expected to furnish such sleeves for free to their customers upon request.

A significant drawback to the non-disposable devices is that, when engaged with a beverage cup, they are typically opaque and do not allow a barista preparing the coffee drink to see the customization details that are typically written on the beverage cup by the order taker. As a result, such devices are impractical to use and would cause disruption in the normal work flow of a retail coffee establishment by requiring the barista to perform the extra labor step of removing the sleeve temporarily in order to complete the preparation of the beverage. But it is a further drawback that the order taker must write the customer's drink order on a new cup every time the customer visits, even when the customer orders the same drink with every visit.

As such, a non-disposable, translucent or transparent sleeve is needed. Such a sleeve would be made from a heat insulating material, would be relatively easy to clean, and would allow for quick reading of a customized drink notations printed thereon. Yet the printing on such a needed device would necessarily be protected from moisture, such as from liquid splashed or dripped down the side of the sleeve. The present invention accomplishes these objectives.

SUMMARY OF THE INVENTION

The present invention is an insulating sleeve combination for a frusto-conical beverage cup, such as is commonly served in retail coffee establishments and the like. Such cups, which are made in various sizes, all include an outer peripheral surface. The combination of the present invention includes an opaque frusto-conical inner sleeve and a frusto-conical outer sleeve. Preferably, at least a portion of the outer sleeve is transparent, such that indicia on the inner sleeve is visible therethrough. Alternately, at least a portion of the outer sleeve may be translucent, whereby the indicia is at least partially visible therethrough. The outer sleeve, in such embodiments, may be made from a silicon rubber material, for example, that has excellent heat insulation properties and serves to insulate a person's hand from a majority of the heat emanating from the cup. Alternately, the outer sleeve may be made from a clear vinyl or other similar translucent or transparent material. The outer surface of the outer sleeve may includes a textured gripping surface, facilitating the manual grasping of the combination by the user.

In use, the consumer typically acquires the present invention in a substantially flat configuration with the inner sleeve engaged within the outer sleeve. The consumer may then remove the inner sleeve and customize a desired beverage order thereon by printing with a pen or applying a pre-printed label thereto. The consumer then engages the inner sleeve with the outer sleeve. Upon ordering, the consumer merely hands the combination of the present invention to the order taker, who reads the pre-printed beverage-indicating indicia on the inner sleeve through the outer sleeve, inserts an appropriate cup therein, and completes the order. The consumer receives the beverage in the cup and, upon finishing the beverage, removes the combination of the present invention from the cup. The process can be repeated day to day, as the outer sleeve is easy to clean. Further, if the consumer ever desires to change his indicated beverage, an alternate inner sleeve can be prepared from conventional card-stock or paperboard material and substituted with the old inner sleeve. Still further, seasonal inner sleeves may be provided to consumers who still retain the outer sleeves, giving the consumer increased ability to express themselves with various styles of inner sleeves. Inner sleeve designs can be supplied at the retail beverage establishments, though pre-cut templates that the user may customize as desired, such as by printing through a color printer or the like, by other sponsors, or by any other of a wide variety of means.

The present invention provides a reusable beverage sleeve that not only protects the environment by reducing the number of disposable sleeves that are used, but also provides a streamlined ordering method for the user and retail beverage establishments. The present device, while more expensive to produce than any one disposable sleeve, actually saves the beverage establishment money by allowing fewer disposable sleeves to be printed. Further, the retail beverage establishment may sell the present invention, rather than providing a disposable sleeve to their customers gratis. A wide variety of designs of inner sleeves may be printed, as well, thereby allowing consumers to express their individuality. Further, inner sleeves may be provided blank for the consumer to print themselves, making the number of inner sleeve combinations endless. Still further, the present invention is even more effective at insulating a consumer's hand from the heat of a hot beverage than a disposable sleeve alone. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
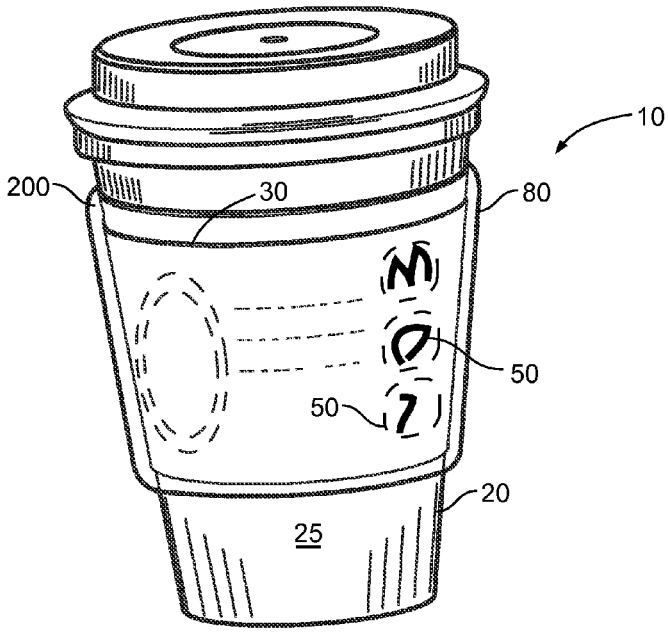
FIG. 1 is a perspective drawing of the invention, illustrating a combination of an inner sleeve fully engaged with an outer sleeve as together engaged to a beverage cup.

FIG. 1 illustrations an insulating sleeve combination 10 for a frusto-conical beverage cup 20, such as is commonly served in retail coffee establishments such as Starbucks Coffee. Such cups 20, of various sizes, all include an outer peripheral surface 25.

Figure 6:
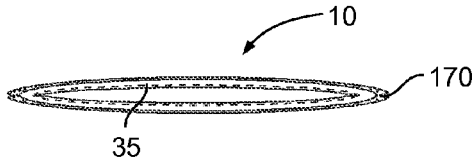
FIG. 6 is a top plan view of the invention, illustrating both the inner sleeve and outer sleeve in a flat configuration.
Figure 8:
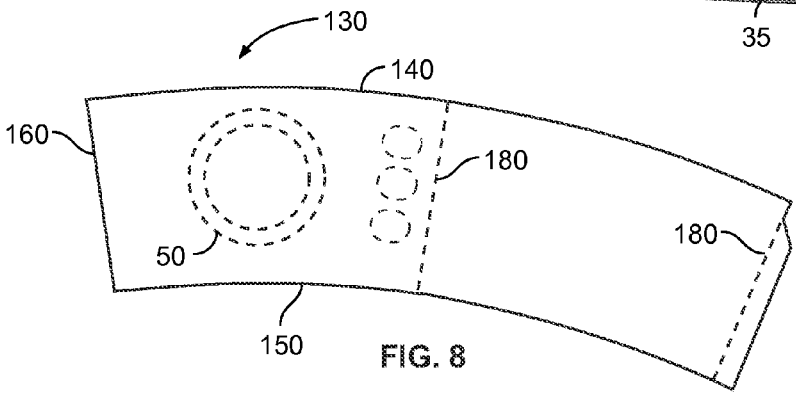
FIG. 8 is a front elevational view of the inner sleeve of the invention, illustrating the inner sleeve as made from a flat arcuate section of paper stock material.

The combination 10 includes an opaque frusto-conical inner sleeve 30 and a frusto-conical outer sleeve 80. The inner sleeve 30 includes an inner surface 35 for engagement with the outer peripheral surface 25 of the cup 20, an outer surface 40 adapted for accepting printed indicia 50 thereon, a top edge 60, and a bottom edge 70. The inner sleeve 30 may be formed from an arcuate section 130 (FIG. 8) of cardboard or cardstock paper, for example, that has a top edge 140, a bottom edge 150, and two side edges 160 that are fixed together. As such, the arcuate section is curved around itself to form the frusto-conical inner sleeve 30. Further, a pair of creases 180 may be formed into the arcuate section 130 between the top and bottom edges 140,150 and at opposing sides thereof so that the inner sleeve 30 formed thereby may be folded substantially flat configuration for storage, transport, and the like (FIG. 6).

The outer sleeve 80 includes an inner surface 90 for engagement with at least a portion of the outer surface 40 of the inner sleeve 30, an outer surface 100, a top edge 110 and a bottom edge 120. The outer sleeve 40 has an inside diameter sufficient to allow at least partial insertion of the inner sleeve 30 within the outer sleeve 80 such that the inner and outer sleeves 30,80 are coaxially aligned. The outer sleeve 80 may further be tapered so that the thickness thereof proximate the bottom edge 120 is substantially thinner than the thickness thereof proximate to the top edge 110 (not shown). As such, insertion of the cup 20 and the combination 10 into a typical vehicle cup holder (not shown) is facilitated.

Figure 7:
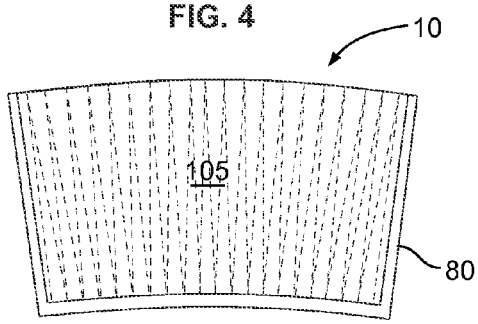
FIG. 7 is a front elevational view of the outer sleeve of the invention, illustrating a gripping texture on the outer surface thereof.

A pair of living hinges 170 may be formed into the outer sleeve 80 between the top and bottom edges 110,120 thereof. Each living hinge 170 is positioned at opposing areas of the inner surface 90 such that the outer sleeve 80 may be collapsed to form a generally flat arc shape (FIGS. 6 and 7). As such, when the inner sleeve 30 is fully engaged in the outer sleeve 80, and with each of the creases 180 of the inner sleeve 30 aligned with one of the living hinges 170 of the outer sleeve, the combination 10 may be collapsed to a generally flat orientation, such as while the combination 10 is not being used. However, in order to use the combination 10, by pressing each living hinge 170 inward, the inner and outer sleeves 30,80 both assume a generally circular configuration in order to allow receipt of the cup 20 therein.

The height d1 of the outer sleeve 80 generally corresponds to the height d2 of the inner sleeve 30. As such, the inner sleeve 30 may be completely contained within the outer sleeve 80, the outer surface 40 of the inner sleeve 30 completely covered by the outer sleeve 80. In such an embodiment, the top edge 60 of the inner sleeve 30 is substantially co-planar with the top edge 110 of the outer sleeve 80, and the bottom edge 60 of the inner sleeve 30 is substantially co-planar with the bottom edge 120 of the outer sleeve 80.

In an alternate embodiment of the invention, however, the bottom edge 120 of the outer sleeve 80 extends past the bottom edge 70 of the inner sleeve 30, thereby defining a bottom lip portion 190 of the outer sleeve 80. The bottom lip portion 190 of the outer sleeve 80, in such an embodiment, may contact the outer peripheral surface 30 of the beverage cup 20. As such, the weight of the beverage cup 20 forces full frictional engagement of the inner sleeve 30 with the outer sleeve 80, but the outer sleeve 80 cannot extend past the inner sleeve 30 since the lip portion 190 presses against and retains the bottom edge 70 of the inner sleeve 30.

Figure 2:
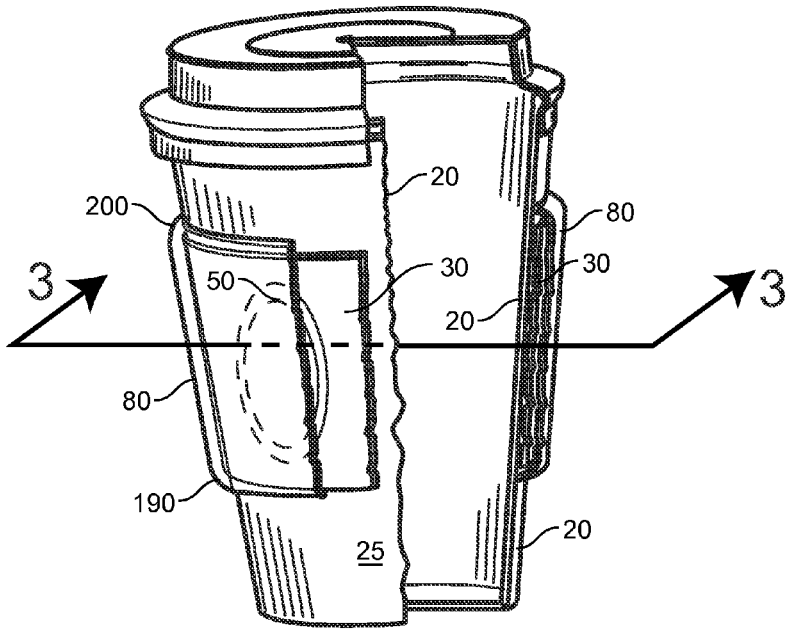
FIG. 2 is a partially cut-away perspective drawing of the invention.
Figure 3:
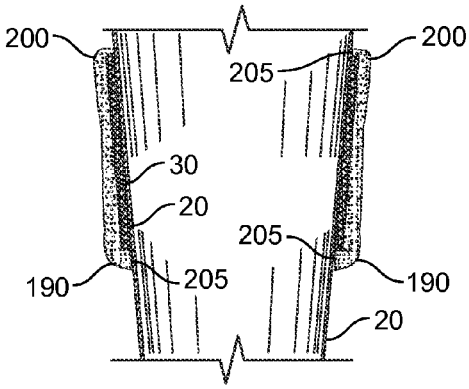
FIG. 3 is a cross-sectional view of the invention, taken generally along lines 3-3 of FIG. 2.
Figure 4:
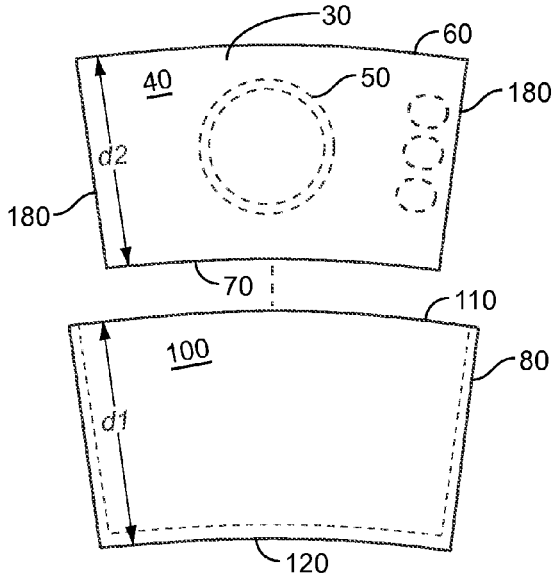
FIG. 4 is an exploded front elevational view of the invention, illustrating the inner sleeve separated from the outer sleeve.
Figure 5:
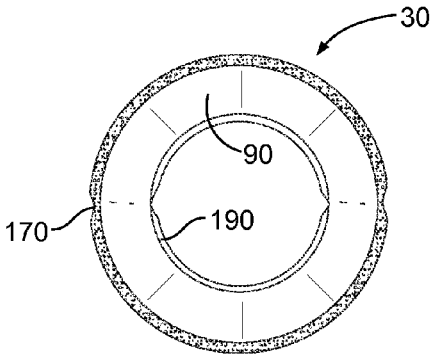
FIG. 5 is a top plan view of the outer sleeve of the invention, illustrating the outer sleeve in a circular configuration for accepting insertion of the inner sleeve and the cup.

In yet another alternate embodiment of the invention, the top edge 110 of the outer sleeve 80 also extends past the top edge 60 of the inner sleeve 30, thereby defining a top lip portion 200 of the outer sleeve (FIGS. 1-3). The top lip portion 200 of the outer sleeve may contact a portion of the peripheral surface 25 of the cup 20 as it encompasses the top edge 60 of the inner sleeve 30. As such, when the user desires to remove the combination 10 from the beverage cup 20, such as when the beverage cup 20 is empty, the top lip portion 200 pulls the inner sleeve 30 away from its frictional engagement with the cup 20. Without such a top lip portion 200, upon pulling the outer sleeve 80 downward away from the cup 20, the inner sleeve 30 may become disengaged with the outer sleeve 80 and remain frictionally engaged to the cup 20. When the outer sleeve 80 is formed from a transparent or translucent silicon rubber, or the like, the frictional engagement between the inner sleeve 30 and the outer sleeve 80 is typically greater than the frictional engagement between the inner sleeve 30 and the peripheral surface 25 of the cup 20. However, with certain combinations of materials for the inner and outer sleeves 30,80, the frictional engagement therebetween is not sufficient to overcome the frictional engagement between the inner sleeve 30 and the peripheral surface 25 of the cup 20, and in such instances having the top lip portion 200 is desired. Each bottom lip portion 190 and top lip portion 200 has a flat inward-facing surface 205 that substantially fully contacts the peripheral surface 25 of the cup 20 (FIG. 3).

Preferably, at least a portion of the outer sleeve 80 is transparent, such that indicia 150 on the inner sleeve 30 is visible therethrough (FIGS. 1 and 2). Alternately, at least a portion of the outer sleeve 80 may be translucent, whereby the indicia 150 is at least partially visible therethrough. The outer sleeve 80, in such embodiments, may be made from a silicon rubber material, for example, that has excellent heat insulation properties and serves to insulate a person's hand from a majority of the heat emanating from the cup 20. Alternately, the outer sleeve 80 may be made from a clear vinyl or other similar translucent or transparent material. The vinyl material may be doped with a scented material to overcome the smell of vinyl out-gassing when heated, such as when engaged to a cup containing a hot beverage. Such a scented material may be, for example, chocolate, vanilla, mint, cinnamon, caramel, hazelnut, cherry, coffee, or other suitable scents.

Figure 9:
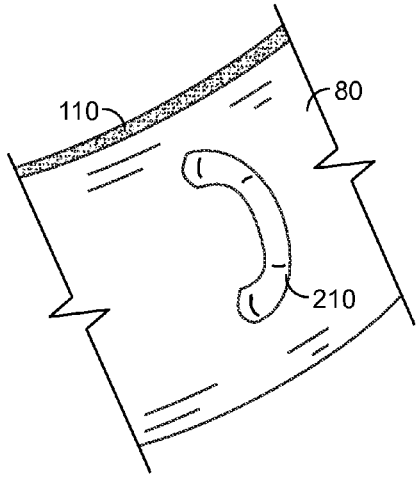
FIG. 9 is a partial perspective view of the invention, illustrating an embodiment of the invention wherein the outer sleeve includes a U-shaped handle formed integrally therewith.

A U-shaped handle 210 (FIG. 9) may further be included, the U-shaped handle 210 extending from one side of the outer surface 100 of the outer sleeve 80, preferably between the two living hinges 170. As such, the cup 20 and the combination 10 may be manually supported by a user grasping the handle 210. The U-shaped handle 210 may be formed integrally with the outer sleeve 80, or may be attached thereto through suitable bonding methods known in the art. The U-shaped handle may be completely filled-in, if desired, to make a tab-shaped handle. Alternately, the outer surface 100 of the outer sleeve 80 may includes a textured gripping surface 105, facilitating the manual grasping of the combination 10 by the user.

In use, the consumer typically acquires the present invention in its flat configuration with the inner sleeve 30 engaged within the outer sleeve 80. The consumer or a store employee may then remove the inner sleeve 30 from the outer sleeve 80 and print a customized drink notation thereon by printing with a pen or applying a pre-printed label 150 thereto. The consumer or employee then engages the inner sleeve 30 with the outer sleeve 40. Upon ordering, the consumer merely hands the combination 10 of the present invention to the order taker, who reads the pre-printed beverage-indicating indicia 150 on the inner sleeve 30 through the outer sleeve 80, inserts an appropriate cup 20 therein, and completes the order. The consumer receives the beverage in the cup 20 and, upon finishing the beverage, removes the combination 10 of the present invention from the cup 20. The process can be repeated day to day, as the outer sleeve 80 is made from an easy-to-clean material.

Further, if the consumer ever desires to change his indicated beverage, an alternate inner sleeve 30 can be prepared from conventional card-stock or paperboard material and substituted with the old inner sleeve 30. Still further, a seasonal inner sleeve 30 may be provided to consumers who still retain the outer sleeve 80, giving the consumer increased ability to express themselves with various styles of inner sleeves 30. Inner sleeve 30 designs can be supplied at the retail beverage establishments, through pre-cut templates that the user may customize as desired such as by printing through a color printer or the like, by other sponsors, or by any other of a wide variety of means. Indeed, several such combinations 10 may be purchased by the consumers, one for each of the consumer's favorite beverages. The inner sleeves 30 of each such combination 10 may be customized to represent the favorite beverage. For example, a summer scene with bright colors may be used to signify a light tea drink, or the like, while a winter scene with frost-covered trees may be printed on the inner sleeve to represent a hot coffee beverage.

While a particular form of the invention has been illustrated and described, it will be apparent that various modifications can be made without departing from the spirit and scope of the invention. For example, the cross-section of the outer sleeve 80 may be varied, taking on a C-shape, an L-shape, a 7-shape or a straight shape. Further, the materials used to form the inner and outer sleeves may be varied by those skilled in the art as needed for various styles or types of cups 20 Accordingly, it is not intended that the invention be limited, except as by the appended claims.

The invention claimed is:

1. An insulating sleeve combination for a frusto-conical beverage cup, the cup including an outer peripheral surface, the combination comprising:

an opaque frusto-conical inner sleeve, the inner sleeve including an inner surface for engagement with the outer peripheral surface of the cup, an outer surface adapted for accepting printed indicia, a top edge and a bottom edge, wherein the inner sleeve comprises an arcuate section of a paper-based material having a top edge, a bottom edge, and two side edges, the two side edges being fixed to one another and the arcuate section folded to form the frusto-conical inner sleeve;

a frusto-conical outer sleeve, the outer sleeve including an inner surface for engagement with at least a portion of the outer surface of the inner sleeve, an outer surface, a top edge, and a bottom edge; the outer sleeve having an inside diameter sufficient to allow at least partial insertion of the inner sleeve within the outer sleeve such that the inner and outer sleeve are coaxially aligned.

2. The combination of claim 1 wherein the top edge of the outer sleeve extends past the top edge of the inner sleeve, thereby defining a top lip portion of the outer sleeve that contacts a portion of the peripheral surface of the cup.

3. The combination of claim 1 wherein at least a portion of the outer sleeve is transparent, such that indicia on the inner sleeve is visible therethrough.

4. The combination of claim 1 wherein at least a portion of the outer sleeve is translucent, such that indicia on the inner sleeve is at least partially visible therethrough.

5. The combination of claim 1 wherein the outer sleeve is made from a transparent silicon rubber material, such that the outer surface of the inner sleeve is visible therethrough.

6. The combination of claim 1 wherein the outer sleeve is made from a translucent silicon rubber material, such that the outer surface of the inner sleeve is at least partially visible therethrough.

7. The combination of claim 1 further including a generally U-shaped handle extending from one side of the outer surface of the outer sleeve, such that the combination and cup can be supported by a user grasping the handle.

8. The combination of claim 1 further including a textured gripping surface formed in the outer surface of the outer sleeve.

9. The combination of claim 1 wherein the bottom edge of the outer sleeve extends past the bottom edge of the inner sleeve, thereby defining a bottom lip portion of the outer sleeve that contacts a portion of the peripheral surface of the cup.

10. The combination of claim 9 wherein the top edge of the outer sleeve extends past the top edge of the inner sleeve, thereby defining a top lip portion of the outer sleeve that contacts a portion of the peripheral surface of the cup.

11. An insulating sleeve combination for a frusto-conical beverage cup, the cup including an outer peripheral surface, the combination comprising:

an opaque frusto-conical inner sleeve, the inner sleeve including an inner surface for engagement with the outer peripheral surface of the cup, an outer surface adapted for accepting printed indicia, a top edge and a bottom edge;

a frusto-conical outer sleeve, the outer sleeve including an inner surface for engagement with at least a portion of the outer surface of the inner sleeve, an outer surface, a top edge, and a bottom edge; the outer sleeve having an inside diameter sufficient to allow at least partial insertion of the inner sleeve within the outer sleeve such that the inner and outer sleeve are coaxially aligned;

wherein a pair of living hinges are formed in the outer sleeve between the top and bottom edges of the outer sleeve, each of the living hinges being positioned at opposing inner surfaces from each other such that the outer sleeve may be collapsed to form a generally flat arc shape.

12. The combination of claim 11 wherein the inner sleeve includes creases formed in the inner sleeve between the top and bottom edges of the inner sleeve, each of the creases aligned with one of the living hinges of the outer sleeve, such that the combination may be collapsed to form a generally flat arc shape.

13. The combination of claim 11 further including a generally U-shaped handle extending from one side of the outer surface of the outer sleeve generally between each of the living hinges, such that the combination and cup can be supported by a user grasping the handle.

* * * * *